US012070102B1

(12) United States Patent
Bates

(10) Patent No.: US 12,070,102 B1
(45) Date of Patent: Aug. 27, 2024

(54) REMOVABLE AND INTERCHANGEABLE SHOE ORNAMENT DEVICE

(71) Applicant: Thomas P. Bates, New Castle, NH (US)

(72) Inventor: Thomas P. Bates, New Castle, NH (US)

( * ) Notice: Subject to any disclaimer, the term of this patent is extended or adjusted under 35 U.S.C. 154(b) by 78 days.

(21) Appl. No.: 17/955,947

(22) Filed: Sep. 29, 2022

Related U.S. Application Data

(60) Provisional application No. 63/252,676, filed on Oct. 6, 2021.

(51) Int. Cl.
*A43B 23/24* (2006.01)
*A43C 11/24* (2006.01)

(52) U.S. Cl.
CPC ..... *A43C 11/24* (2013.01); *A43B 23/24* (2013.01)

(58) Field of Classification Search
CPC ..... A43C 11/24; A43C 19/00; A43B 23/24
USPC ..... 36/136
See application file for complete search history.

(56) References Cited

U.S. PATENT DOCUMENTS

2005/0160569 A1* 7/2005 Liu ..... A43C 11/24 24/712.5
2006/0254089 A1* 11/2006 Frydlewski ..... A43C 11/008 36/50.1
2015/0128454 A1* 5/2015 Sykes ..... A43B 23/24 2/245
2015/0366294 A1* 12/2015 Riccardi ..... A43B 23/24 2/245
2016/0157559 A1* 6/2016 Schwartz ..... A43B 23/25 36/136

OTHER PUBLICATIONS

Prior Art Horse Bit Loafer—Sep. 28, 2022.
Prior Art Riomar Footwear—Sep. 28, 2022.
Prior Art Jewelry Clip Footwear—Sep. 28, 2022.

* cited by examiner

*Primary Examiner* — Marie D Bays
(74) *Attorney, Agent, or Firm* — DeLio Peterson & Curcio LLC; Robert Curcio

(57) ABSTRACT

Footwear having removably attachable ornamentation device includes a pair of rings, with each threaded through the eye of a strap on the footwear. A leg portion has a pair of ferrules at opposite ends, with each ferrule having a cylindrical central opening and a slot forming an open cavity. The at least one engagement pin is disposed within the central opening and the pin cross-sectional length extends across the central opening diameter. The ornamentation device is disposed in place on the footwear with the rings being substantially linearly aligned with the leg portion and with the pin cross-sectional width being out of alignment with ferrule slot to hold the rings and ferrules securely in place. The leg portion is removable by turning the rings to align the pin cross-sectional width with the ferrule slots and slide the at least one engagement pin of the rings out of the ferrules.

20 Claims, 10 Drawing Sheets

REMOVABLE AND INTERCHANGEABLE SHOE ORNAMENT DEVICE

BACKGROUND OF THE INVENTION

1. Field of the Invention

The present invention relates to ornamentation and other devices for footwear.

2. Description of Related Art

Footwear may contain devices of an ornamental nature, such as an ornamental animal bit, on the upper side. However, such ornamentation is not generally or easily removable, and cannot be easily swapped out for different types of ornamentation on the same shoe.

SUMMARY OF THE INVENTION

Bearing in mind the problems and deficiencies of the prior art, it is therefore an object of the present invention to provide ornamentation and other devices which may be attached to the top of footwear, for example an ornamental animal bit on the top surface of a loafer-type shoe, and may be easily removed to be replaced on the same footwear.

It is another object of the present invention to provide a method for easily applying, removing and replacing ornamentation and other devices to footwear.

Still other objects and advantages of the invention will in part be obvious and will in part be apparent from the specification.

The above and other objects, which will be apparent to those skilled in the art, are achieved in the present invention which is directed to footwear having a removably attachable ornamentation or other device. The footwear has a pair of spaced-apart straps with eyes on or adjacent an upper surface thereof. The device includes a pair of rings, with each ring defining a loop with a straight portion comprising at least one non-circular engagement pin, the at least one engagement pin having a pin cross-sectional length and width. Each ring is threaded through the eye of one of the straps with the at least one engagement pin generally upward of the straps. The device further includes a leg portion having a pair of ferrules at opposite ends of the leg portion, with each ferrule having a cylindrical central opening along a longitudinal axis thereof, perpendicular to a longitudinal axis of the leg portion, and a slot extending to the central opening forming an open cavity. The central opening has a diameter approximately equal to or greater than that of the pin cross-sectional length, and the slot has a width sufficient to permit the pin cross-sectional width to pass therethrough. The at least one engagement pin is disposed within the central opening and the pin cross-sectional length extends across the central opening diameter. The device comprising the rings and leg portion is disposed in place on the upper surface of the footwear with the planes of the rings being substantially linearly aligned with the longitudinal axis of the leg portion and with the pin cross-sectional width being out of alignment with ferrule slot to hold the rings and ferrules securely in place. The leg portion is removable by turning the rings with respect to the leg portion and ferrule to align the pin cross-sectional width with the ferrule slots and slide the at least one engagement pin of the rings out of the ferrules.

The present invention also provides a method of removably attachable ornamentation or other device to footwear.

There is provided footwear having a pair of spaced-apart straps with eyes on or adjacent an upper surface thereof. There is also provided a device comprising a pair of rings and a leg portion. Each ring defines a loop with a straight portion comprising at least one non-circular engagement pin, with the at least one engagement pin having a pin cross-sectional length and width. The leg portion has a pair of ferrules at opposite ends of the leg portion, with each ferrule having a cylindrical central opening along a longitudinal axis thereof, perpendicular to a longitudinal axis of the leg portion, and a slot extending to the central opening forming an open cavity. The central opening has a diameter approximately equal to or greater than that of the pin cross-sectional length, and the slot has a width sufficient to permit the pin cross-sectional width to pass therethrough. The method then includes threading each ring through the eye of one of the straps with the at least one engagement pin generally upward of the straps, and turning the rings with respect to the leg portion and ferrule to align the pin cross-sectional width with the ferrule slots and slide the at least one engagement pin of the rings into the ferrules to position the at least one engagement within the central opening and the pin cross-sectional length across the central opening diameter. The method then includes positioning the device comprising the rings and leg portion in place on the upper surface of the footwear with the planes of the rings substantially linearly aligned with the longitudinal axis of the leg portion and with the pin cross-sectional width being out of alignment with ferrule slot to hold the rings and ferrules securely in place.

The present invention further provides a removably attachable ornamentation or other device for footwear comprising a pair of rings, with each ring defining a loop with a straight portion comprising at least one non-circular engagement pin, the at least one engagement pin having a pin cross-sectional length and width. Each ring is threadable through the eyes of a pair of spaced-apart straps with eyes on or adjacent an upper surface of the footwear with the at least one engagement pin generally upward of the straps. The device further includes a leg portion having a pair of ferrules at opposite ends of the leg portion, with each ferrule having a cylindrical central opening along a longitudinal axis thereof, perpendicular to a longitudinal axis of the leg portion, and a slot extending to the central opening forming an open cavity. The central opening has a diameter approximately equal to or greater than that of the pin cross-sectional length, the slot having a width sufficient to permit the pin cross-sectional width to pass therethrough. The device comprising the rings and leg portion is positionable on the upper surface of the footwear with the pin cross-sectional width being out of alignment with ferrule slot to hold the rings and ferrules securely in place. The leg portion is removable by turning the rings with respect to the leg portion and ferrule to align the pin cross-sectional width with the ferrule slots and slide the at least one engagement pin of the rings out of the ferrules.

The at least one non-circular engagement pin may comprise a pair of non-circular engagement pins extending toward each other, with a gap between spaced ends of the rings. The leg portion may comprise a pair of legs, with each leg having at one end a ferrule, the legs being connected at ends opposite the ferrules. Each of the legs may have a loop disposed on the end opposite the ferrules, with one loop being continuous and the other loop being continuous except for a gap, the loops being linked when the device is in place on the top of the footwear, and the legs being separable by removing the one loop through the gap of the other loop when the leg portion is removed.

The at least one engagement pin may have a rectangular pin cross-sectional configuration, with a length and a width. The rings may be planar and the pin cross-sectional length may be aligned at an acute angle with respect to the planes of the rings. The slot may have a centerline aligned at an acute angle with respect to the longitudinal axis of the leg portion.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

The present invention is directed to a removable device for attachment to the top of a shoe or other footwear, such as an ornament that simulates an animal bit (also referred to herein as a shoe bit), and a method of attaching and detaching the device. The invention permits the wearer to easily remove and replace the ornamentation or other device by hand, as desired.

An example of the invention directed to the removable shoe bit on a loafer, and the method of attachment/detachment, is shown in the attached drawing FIGS. 1-16, in which like numerals refer to like features of the invention.

The exemplary device 20 to be attached to the footwear is shown as an ornament, here in the form of a shoe bit to be attached to the upper portion of a loafer-style shoe. Device 20 as shown includes a pair of D-rings 30 having a curved portion 32 for securing to the footwear, although configurations other than a "D" shape may be used. Connecting the rings 30 is a leg portion, shown as a pair of legs 40*a*, 40*b*, having at opposite ends a ferrule portion 50 for securing to the rings 30, and at the central ends a loop portion 60*a* or 60*b* for connecting the legs. Legs 40*a*, 40*b* are identical except for the different loops 60*a*, 60*b*, as will be described further below. The connected legs in the ornamental shoe bit device 20 correspond to the bit mouthpiece that goes inside the animal's mouth in a real animal bit, and the D-rings in the ornamental shoe bit device 20 correspond to the rings to which the bridle would attach in a real animal bit. The rings and ferrules may be made of a metal or plastic, and if the latter, may be plated or otherwise coated with a metal.

Figure 7:
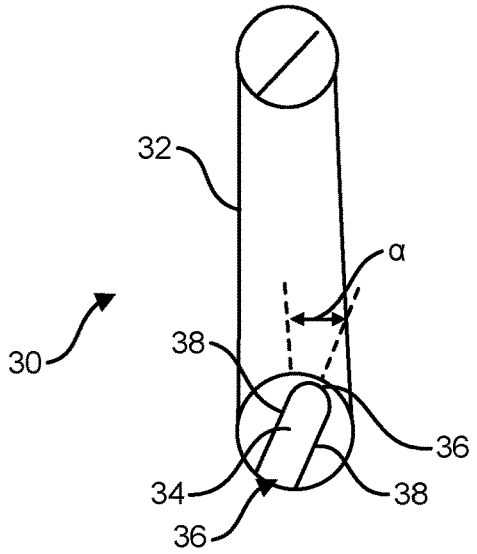
FIG. 7 is a sectional view of the D-ring, along line 7-7 of FIG. 6.
Figure 8:
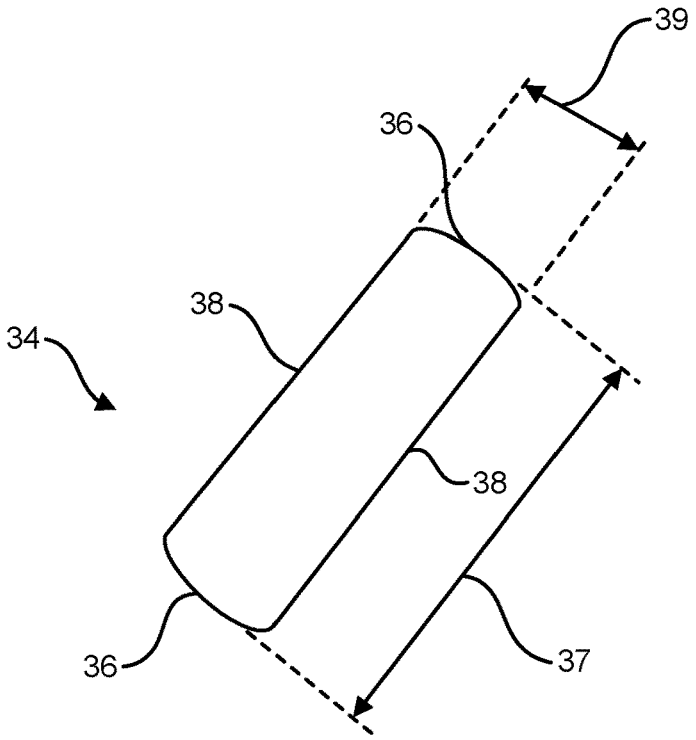
FIG. 8 is a cross-sectional view of the engagement pin of the D-ring, along line 8-8 of FIG. 6.
Figure 9:
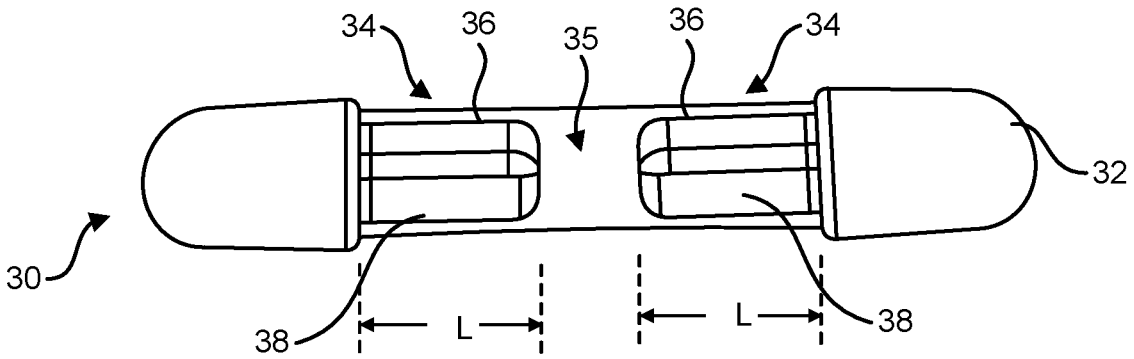
FIG. 9 is an end view of the D-ring of FIG. 6.
Figure 10:
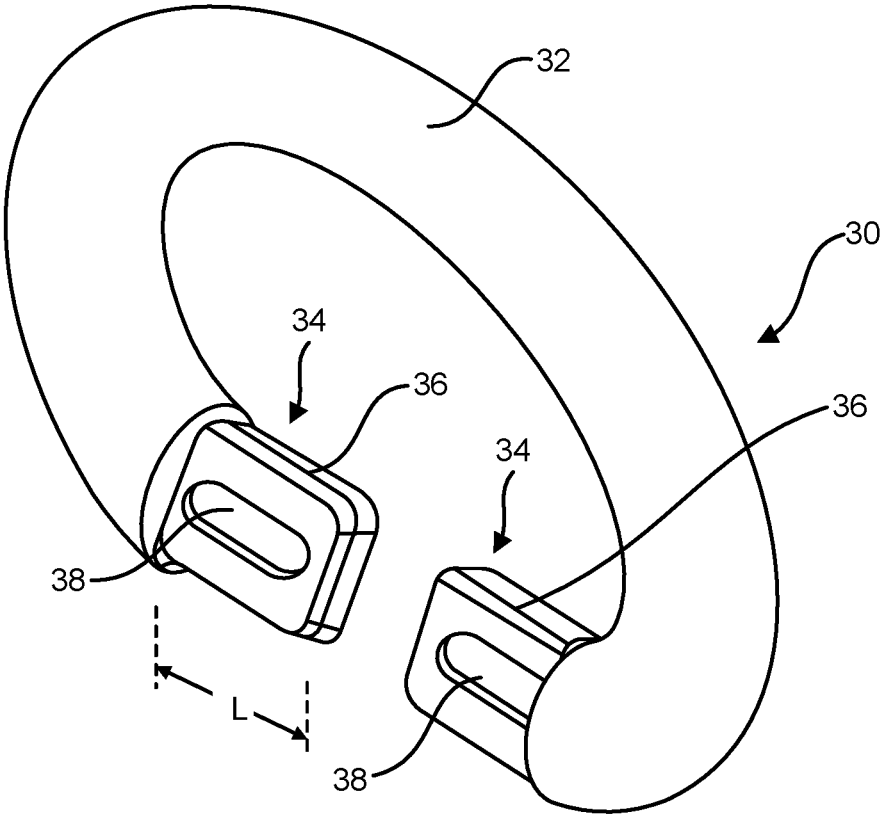
FIG. 10 is a perspective view of the D-ring of FIG. 6.

Each of the rings 30 in the shoe bit embodiment define a loop with a straight portion comprising a pair of engagement pins 34 extending toward each other with a gap 35 between spaced ends of the rings. The engagement pins are non-circular in cross section (FIG. 8) and have longitudinal length/(FIG. 9). As shown in FIGS. 7 and 8, respectively, the pins 34 are rectangular in cross-sectional configuration with curved ends 36 across the cross-sectional width 39, and a cross-sectional length 37 between the curved ends 36 less than the diameter of the ring adjacent the pin. The length of the pins may be aligned at an acute angle $\alpha$, for example, about 25° as shown, with respect to the plane of ring 30 (FIG. 7). The sides 38 along the length of the pins 34 may be substantially flat, with optional depressions.

Figure 1:
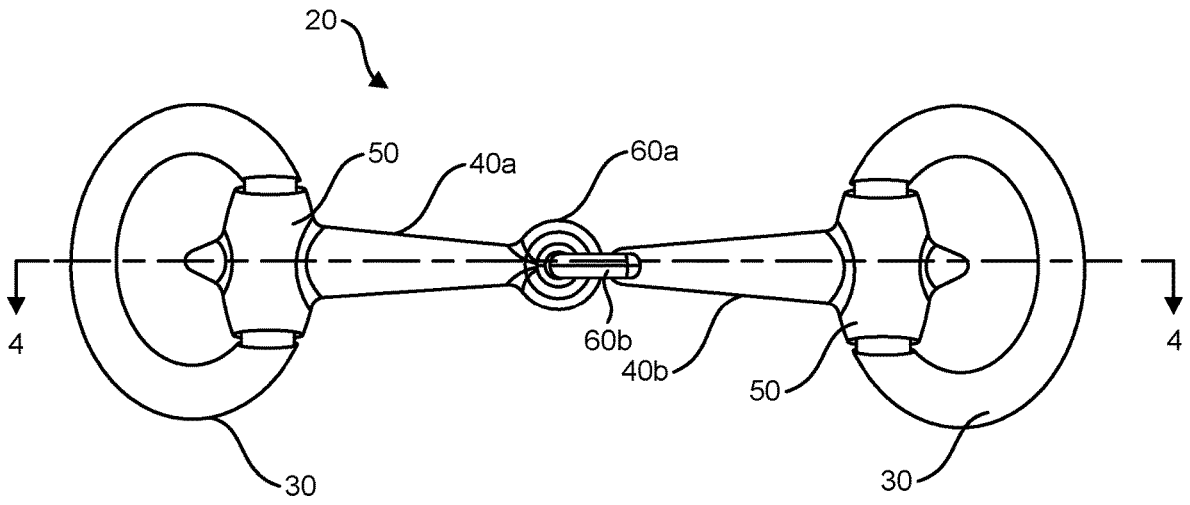
FIG. 1 is a top view of the device of the present invention for attachment to the top of footwear, shown as an ornamental animal bit.
Figure 2:
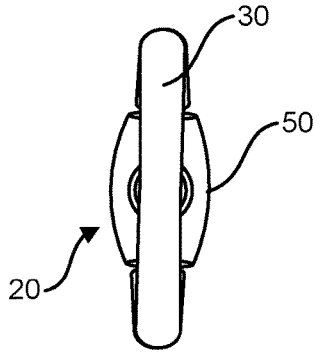
FIG. 2 is an end view of the ornamental shoe bit device of FIG. 1.
Figure 3:
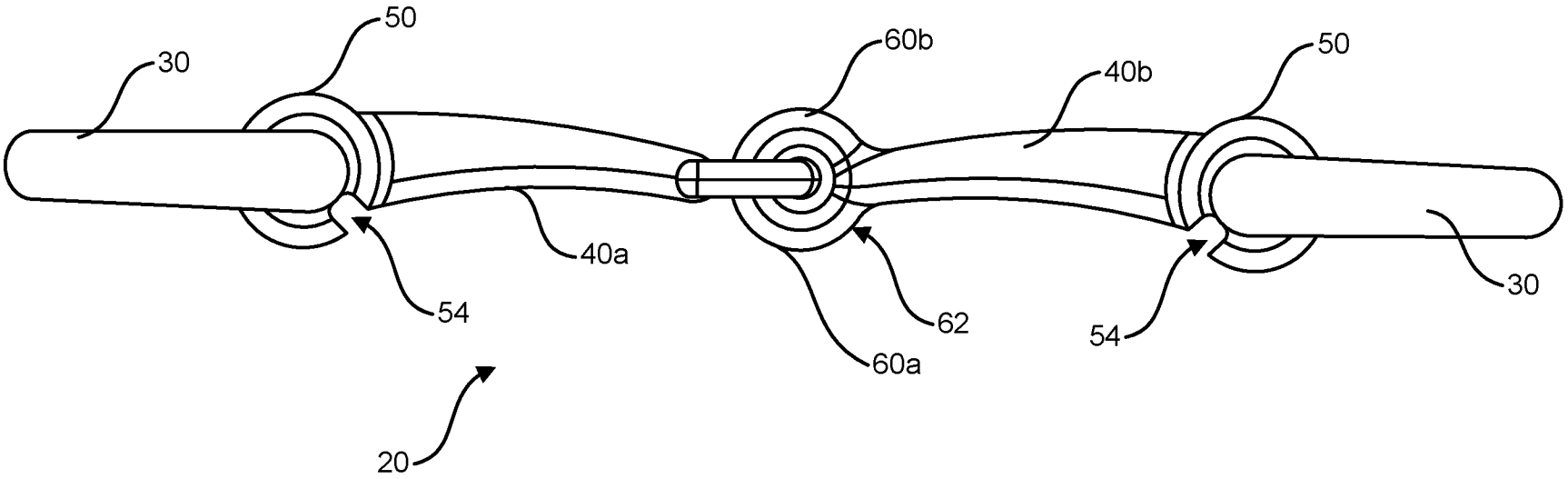
FIG. 3 is a side view of the ornamental shoe bit device of FIG. 1.
Figure 4:
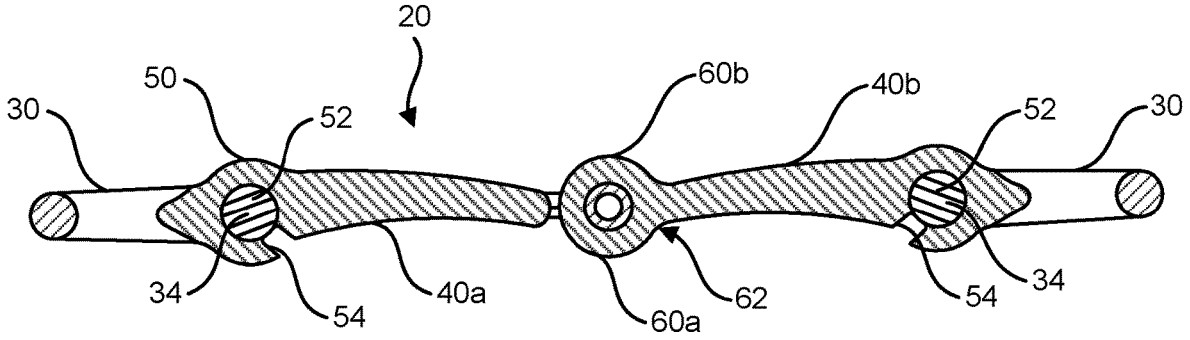
FIG. 4 is a cross-sectional side of the ornamental animal bit device, along line 4-4 of FIG. 1.
Figure 5:
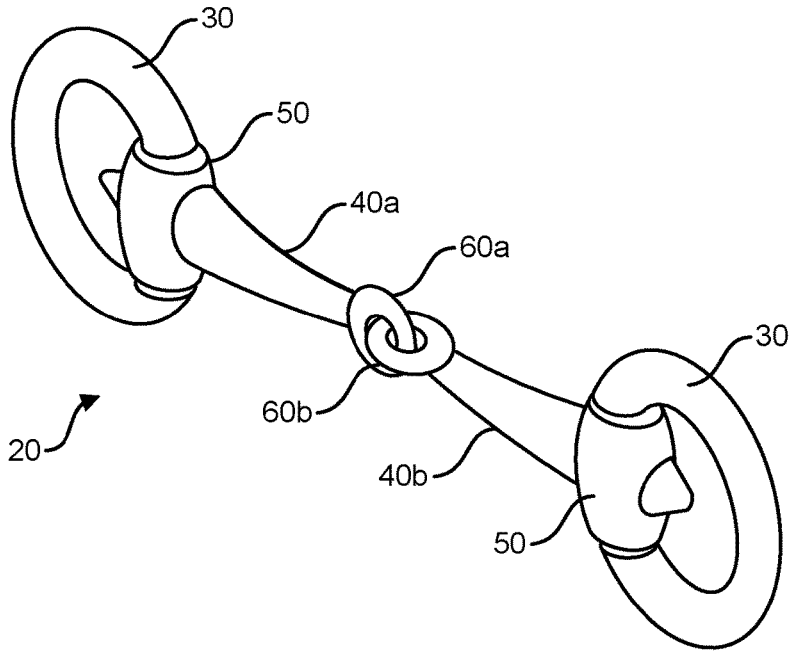
FIG. 5 is a perspective view of the ornamental shoe bit device of FIG. 1.
Figure 6:
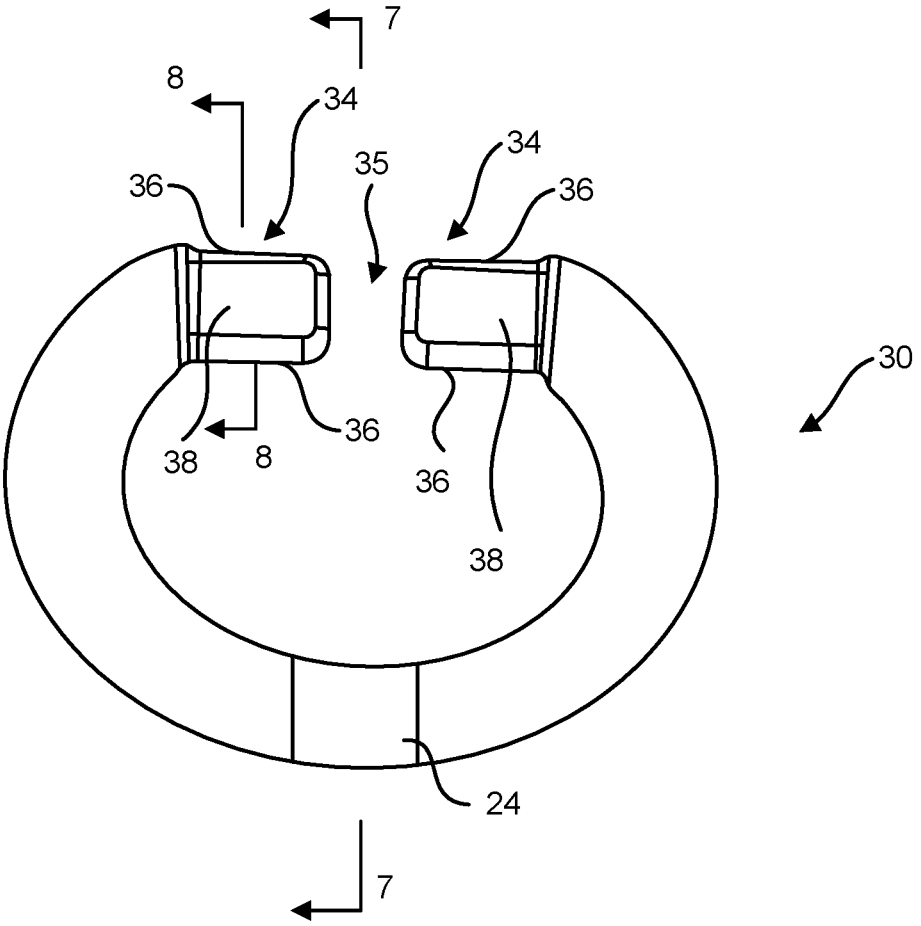
FIG. 6 is a top view of the D-ring of the ornamental shoe bit device of FIG. 1.
Figure 11:
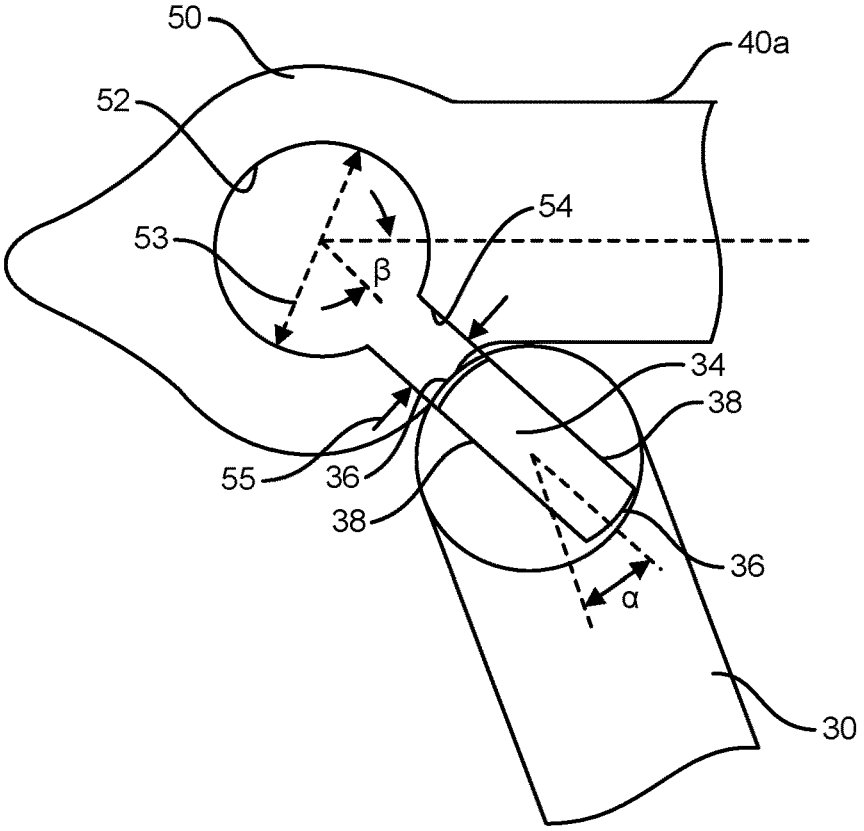
FIG. 11 is a close-up cross-sectional view of the engagement pin of the D-ring aligned to be inserted into the slot of the ferrule portion of the leg, in the ornamental shoe bit device of FIG. 1.
Figure 12:
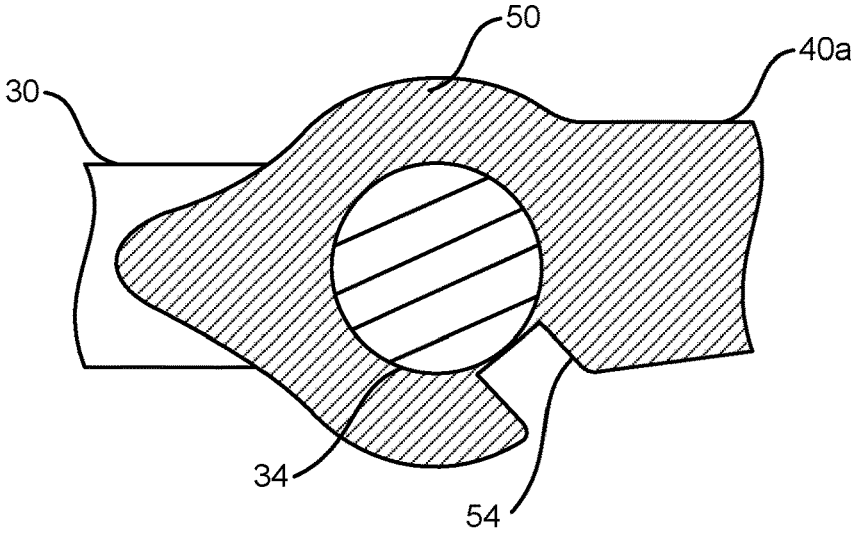
FIG. 12 is a close-up cross-sectional view of the engagement pin of the D-ring secured in the ferrule portion of the leg, in the ornamental shoe bit device of FIG. 1.
Figure 13:
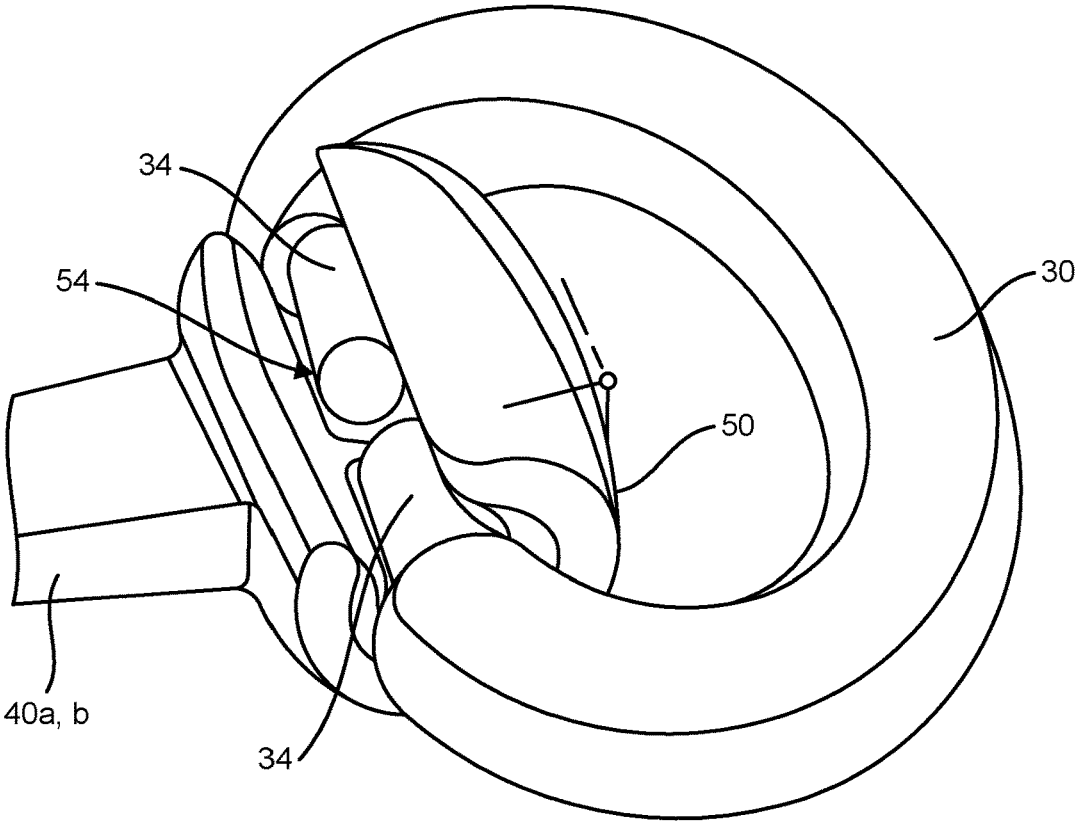
FIG. 13 is a perspective view of the engagement pin of the D-ring secured in the ferrule portion of the leg, in the ornamental shoe bit device of FIG. 1.

Each leg 40*a*, 40*b* of the leg portion may be straight, or slightly curved as shown in FIGS. 3 and 4 to conform to the upper surface of the footwear. The ferrule 50 on opposite ends of the leg portion, i.e., one end of each of the legs 40*a*, 40*b*. may be barrel-shaped as shown, with a cylindrical central opening 52 extending along the ferrule longitudinal axis, perpendicular to the longitudinal axis along the length of the leg. A slot 54 extends the length of the ferrule 50, parallel to the ferrule longitudinal axis, between the ferrule surface and the interior central opening 52, forming an open cavity. As shown in FIG. 11, the diameter 53 of the central opening 52 may be approximately equal to or greater than that of the pin cross-sectional length. The width 55 of slot 54 may be approximately equal to or greater than that of the pin cross-sectional width 39, or slightly less if the ferrule is made from a flexible plastic, sufficient to permit the pin cross-sectional width to pass therethrough. The slot 54 centerline may be aligned at an acute angle ß, for example, about 45° as shown, with respect to the leg 40*a* longitudinal axis. The engagement pins 34 pin cross-sectional widths 39 are aligned with the sides of ferrule slot 54 and, with the pin cross-sectional length directed toward the center of the central opening, the pins are inserted into the slot to enter the open cavity on the ferrule. Once the pair of pins on the D-ring 30 are within the ferrule central opening 52, the ring is then rotated with the pin cross-sectional length 37 across the central opening diameter to hold the ring and ferrule in place with respect to each other, as shown in FIG. 12 (a close-up of FIG. 4). In turning the ring with respect to the leg and ferrule so that the leg portions 40*a*, 40*b* and the planes of the rings 30 are substantially linearly aligned, the cross-sectional widths of the pins turn and pass out of engagement with the slot on the inside of the ferrule cavity and move pins 34 cross-sectional width out of alignment with ferrule slot 54, which restricts and prevents the ring from falling out of the ferrule.

Loops 60*a*, 60*b* may disposed on the ends of legs 40*a*, 40*b*, respectively, opposite the ferrules 50, and connect the legs at the center of the device 20. One loop, 60*a* as shown, is continuous and the other loop, 60*b* as shown, is continuous except for gap 62. The axes of the central openings of loops 60*a*, 60*b* are perpendicular to each other when connected, with the axis of the central opening of loop 60*b* being parallel to the axis of the central opening of ferrule 50 of leg 40*b*, and the axis of the central opening of loop 60*a* being perpendicular to the axis of the central opening of ferrule 50 of leg 40*a*. If the legs are made from a flexible plastic, gap 62 of loop 60*b* has a width that may be approximately less than the diameter or thickness loop 60*a* as shown in FIG. 4, so that the gap is flexed open as loop 60*a* is inserted therethrough, to link the loops together. The legs 40*a*, 40*b* may be connected by their respective loops 60*a*, 60*b*, respectively, either before or after the legs are connected to the D-rings.

Figure 14:
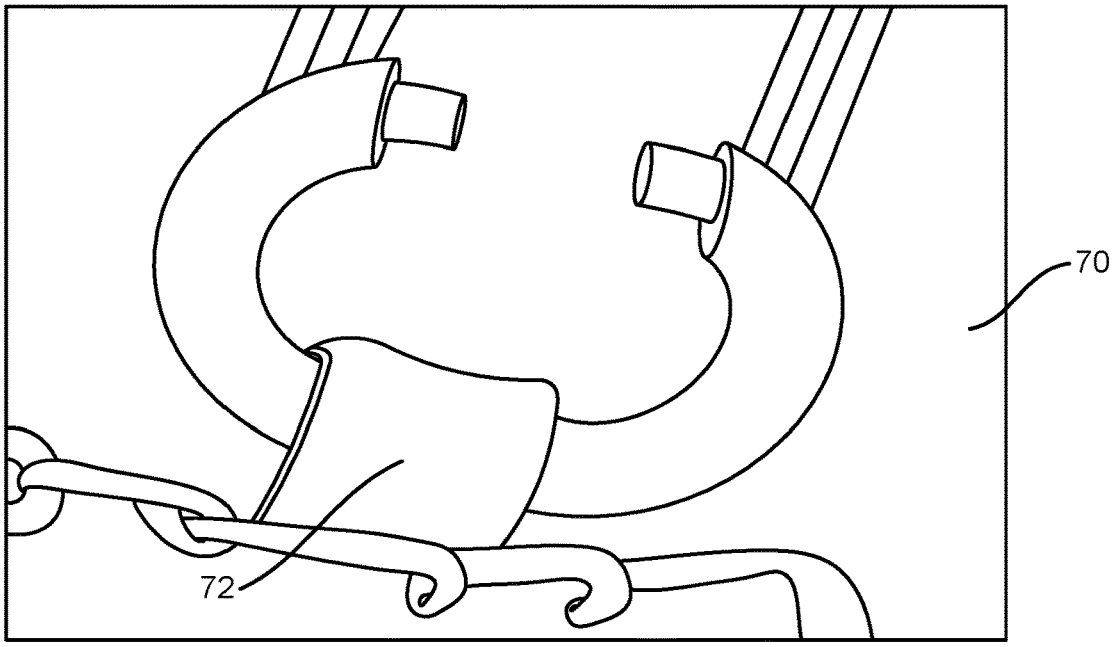
FIG. 14 is a perspective view of the curved portion of the D-ring of the ornamental shoe bit device of FIG. 1 secured in loop on the top edge of footwear, shown as a loafer-type shoe.
Figure 15:
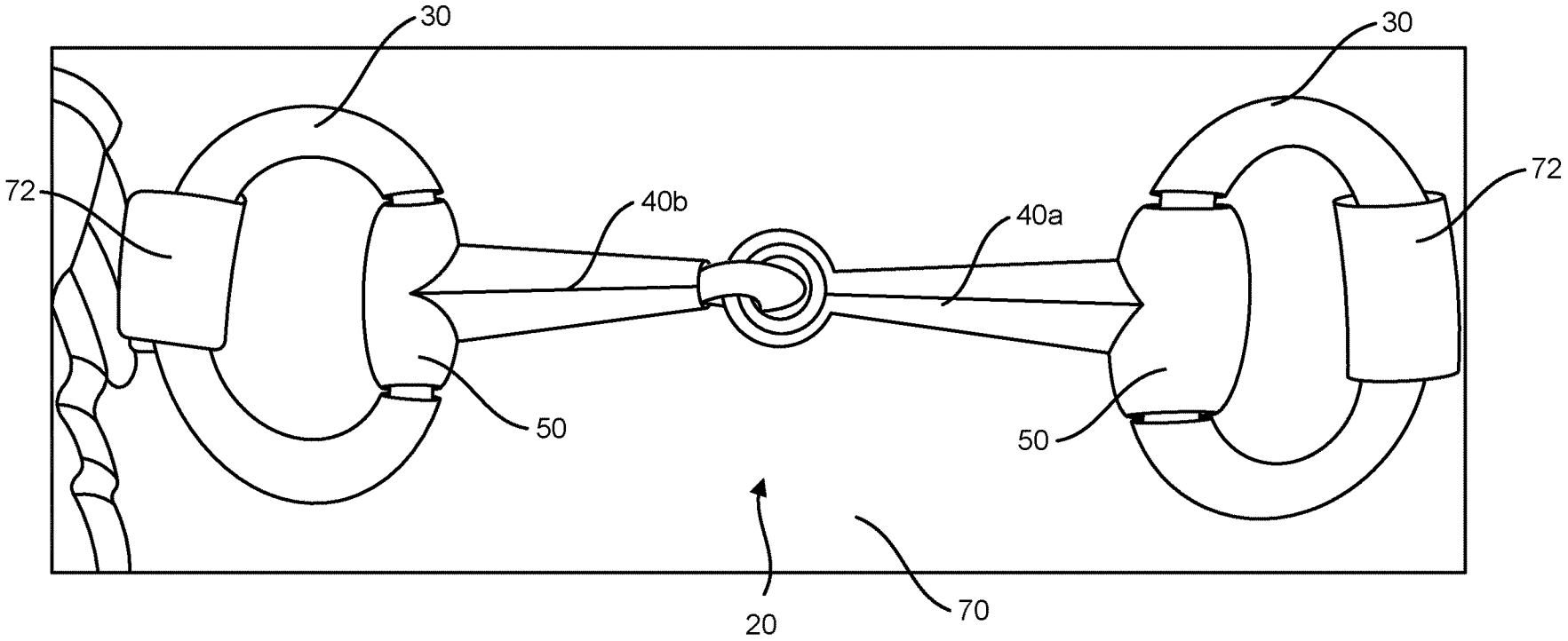
FIG. 15 is a top view of the ornamental shoe bit device of FIG. 1 secured in the loop on opposite sides of the loafer-type shoe footwear of FIG. 14.
Figure 16:
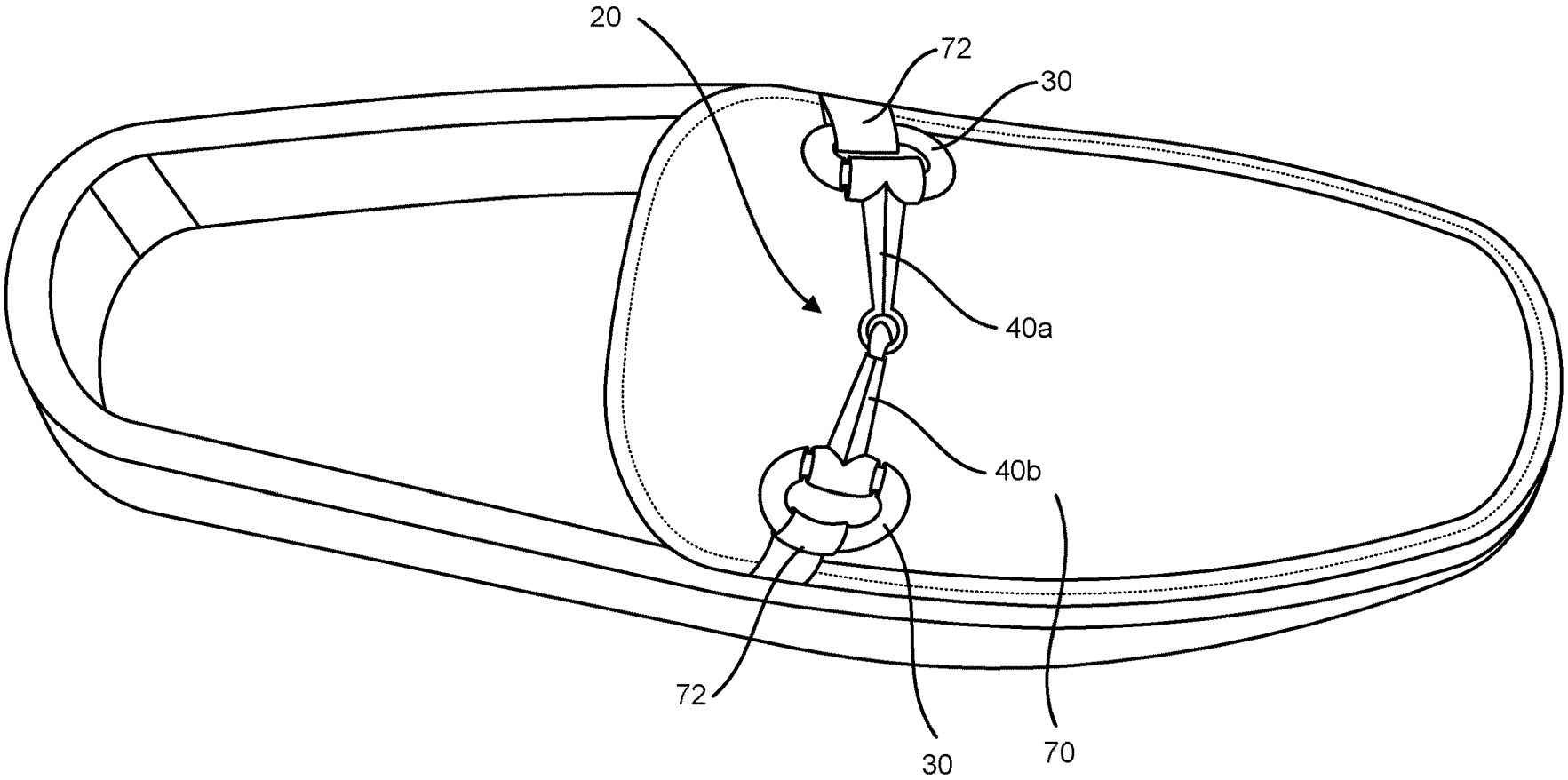
FIG. 16 is a top perspective view of the loafer-type shoe footwear with the ornamental shoe bit device of FIG. 1 removably secured on the top thereof.

To attach the device 20 to the wearer's footwear 70, a pair of spaced-apart straps 72 with eyes, made of leather or other flexible material, are provided on either side of or adjacent to the upper surface as shown in FIGS. 14-16. The gap 35 of each D-ring 30 is threaded through the eyes of straps 72 to secure the D-rings in the straps with the engagement pins being generally upward (FIG. 14). Subsequently ferrules 50 of legs 40*a*, 40*b* are attached to the D-rings and legs 40*a*, 40*b* linked together as described above, in any sequence. Device 20 then rests securely in place on the upper surface of the shoe 70 with the device being slightly curved over the top of the shoe but substantially linearly aligned as shown in FIGS. 1-4, 15 and 16. To remove device 20, the rings are rotated by hand and turned with respect to the legs and ferrules to align the pin cross-sectional width with the ferrule slots and slide the engagement pins of the rings out of the ferrules. The legs may be then swapped and replaced as desired, or the rings removed from the footwear straps and replaced as well.

Thus, the present invention provides the advantages that the wearer can then use the device 20 bit or other ornamentation as-is, or then subsequently easily remove the device from footwear 70, without tools, by reversing the assembly described above, and replace and change the device bit again with another bit or ornamentation 20. Replacement could be with a different color shoe bit or other ornamentation, such as from nickel to brass. Alternatively, the "bit," portion, i.e., legs 40*a*, 40*b*, may be replaced with a non-metal ornamentation such as that made of fabric, leather or braided rope.

While the present invention has been particularly described, in conjunction with one or more specific embodiments, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. Footwear having a removably attachable ornamentation or other device comprising:

footwear having a pair of spaced-apart straps with eyes on or adjacent an upper surface thereof;

a pair of rings, each ring defining a loop with a straight portion comprising at least one non-circular engagement pin, the at least one engagement pin having a pin cross-sectional length and width, each ring being threaded through the eye of one of the straps with the at least one engagement pin generally upward of the straps; and a leg portion having a pair of ferrules at opposite ends of the leg portion, each ferrule having a cylindrical central opening along a longitudinal axis thereof, perpendicular to a longitudinal axis of the leg portion, and a slot extending to the central opening forming an open cavity, the central opening having a diameter approximately equal to or greater than that of the pin cross-sectional length, the slot having a width sufficient to permit the pin cross-sectional width to pass therethrough, the at least one engagement being disposed within the central opening and the pin cross-sectional length being across the central opening diameter, the device comprising the rings and leg portion being disposed in place on the upper surface of the footwear with the planes of the rings substantially linearly aligned with the longitudinal axis of the leg portion and with the pin cross-sectional width being out of alignment with the ferrule slot to hold the rings and ferrules securely in place, the leg portion being removable by turning the rings with respect to the leg portion and ferrule to align the pin cross-sectional width with the ferrule slots and slide the at least one engagement pin of the rings out of the ferrules.

2. The footwear of claim 1 wherein the at least one non-circular engagement pin comprises a pair of non-circular engagement pins extending toward each other, with a gap between spaced ends of the rings.

3. The footwear of claim 1 wherein the leg portion comprises a pair of legs, each leg having at one end a ferrule, the legs being connected at ends opposite the ferrules.

4. The footwear of claim 3 wherein each of the legs has a loop disposed on the end opposite the ferrules, with one loop being continuous and the other loop being continuous except for a gap, the loops being linked when the device is in place on the top of the footwear, the legs being separable by removing the one loop through the gap of the other loop when the leg portion is removed.

5. The footwear of claim 1 wherein the at least one engagement pin has a rectangular pin cross-sectional configuration, with a length and a width.

6. The footwear of claim 5 wherein the rings are planar and the pin cross-sectional length is aligned at an acute angle with respect to the planes of the rings.

7. The footwear of claim 1 wherein the slot has a centerline aligned at an acute angle with respect to the longitudinal axis of the leg portion.

8. A method of removably attachable ornamentation or other device to footwear comprising:

providing footwear having a pair of spaced-apart straps with eyes on or adjacent an upper surface thereof;

providing a device comprising a pair of rings and a leg portion, each ring defining a loop with a straight portion comprising at least one non-circular engagement pin, the at least one engagement pin having a pin cross-sectional length and width, the leg portion having a pair of ferrules at opposite ends of the leg portion, each ferrule having a cylindrical central opening along a longitudinal axis thereof, perpendicular to a longitudinal axis of the leg portion, and a slot extending to the central opening forming an open cavity, the central opening having a diameter approximately equal to or greater than that of the pin cross-sectional length, the slot having a width sufficient to permit the pin cross-sectional width to pass therethrough threading each ring through the eye of one of the straps with the at least one engagement pin generally upward of the straps; and turning the rings with respect to the leg portion and ferrule to align the pin cross-sectional width with the ferrule slots and slide the at least one engagement pin of the rings into the ferrules to position the at least one engagement within the central opening and the pin cross-sectional length across the central opening diameter, positioning the device comprising the rings and leg portion in place on the upper surface of the footwear with the planes of the rings substantially linearly aligned with the longitudinal axis of the leg portion and with the pin cross-sectional width being out of alignment with ferrule slot to hold the rings and ferrules securely in place.

9. The method of claim 8 further including removing the leg portion by turning the rings with respect to the leg portion and ferrule to align the pin cross-sectional width with the ferrule slots and slide the at least one engagement pin of the rings out of the ferrules, and optionally removing the rings from the straps.

10. The method of claim 8 wherein the at least one non-circular engagement pin comprises a pair of non-circular engagement pins extending toward each other, with a gap between spaced ends of the rings.

11. The method of claim 8 wherein the leg portion comprises a pair of legs, each leg having at one end a ferrule, the legs being connected at ends opposite the ferrules.

12. The method of claim 11 wherein each of the legs has a loop disposed on the end opposite the ferrules, with one loop being continuous and the other loop being continuous except for a gap, the loops being linked when the device is in place on the top of the footwear, the legs being separable by removing the one loop through the gap of the other loop when the leg portion is removed.

13. The method of claim 8 wherein the rings are planar, the at least one engagement pin has a rectangular pin cross-sectional configuration, with a length and a width and the pin cross-sectional length is aligned at an acute angle with respect to the planes of the rings.

14. The method of claim 8 wherein the slot has a centerline aligned at an acute angle with respect to the longitudinal axis of the leg portion.

15. A removably attachable ornamentation or other device for footwear comprising:

a pair of rings, each ring defining a loop with a straight portion comprising at least one non-circular engagement pin, the at least one engagement pin having a pin cross-sectional length and width, each ring being threadable through the eyes of a pair of spaced-apart straps with eyes on or adjacent an upper surface of the footwear with the at least one engagement pin generally upward of the straps; and a leg portion having a pair of ferrules at opposite ends of the leg portion, each ferrule having a cylindrical central opening along a longitudinal axis thereof, perpendicular to a longitudinal axis of the leg portion, and a slot extending to the central opening forming an open cavity, the central opening having a diameter approximately equal to or greater than that of the pin cross-sectional length, the slot having a width sufficient to permit the pin cross-sectional width to pass therethrough, the device comprising the rings and leg portion being positionable on the upper surface of the footwear with the pin cross-sectional width being out of alignment with ferrule slot to hold the rings and ferrules securely in place, the leg portion being removable by turning the rings with respect to the leg portion and ferrule to align the pin cross-sectional width with the ferrule slots and slide the at least one engagement pin of the rings out of the ferrules.

16. The device of claim 15 wherein the at least one non-circular engagement pin comprises a pair of non-circular engagement pins extending toward each other, with a gap between spaced ends of the rings.

17. The device of claim 15 wherein the leg portion comprises a pair of legs, each leg having at one end a ferrule, the legs being connected at ends opposite the ferrules.

18. The device of claim 17 wherein each of the legs has a loop disposed on the end opposite the ferrules, with one loop being continuous and the other loop being continuous except for a gap, the loops being linked when the device is in place on the top of the footwear, the legs being separable by removing the one loop through the gap of the other loop when the leg portion is removed.

19. The device of claim 15 wherein the at least one engagement pin has a rectangular pin cross-sectional configuration, with a length and a width.

20. The device of claim 19 wherein the rings are planar and the pin cross-sectional length is aligned at an acute angle with respect to the planes of the rings, and the slot has a centerline aligned at an acute angle with respect to the longitudinal axis of the leg portion.

* * * * *